US007278500B2

(12) United States Patent
Brolund

(10) Patent No.: US 7,278,500 B2
(45) Date of Patent: Oct. 9, 2007

(54) ROLLER CUTTER

(75) Inventor: Stig-Åke Brolund, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 10/540,872

(22) PCT Filed: Jan. 29, 2004

(86) PCT No.: PCT/SE2004/000116

§ 371 (c)(1),
(2), (4) Date: Mar. 8, 2006

(87) PCT Pub. No.: WO2004/067900

PCT Pub. Date: Aug. 12, 2004

(65) Prior Publication Data

US 2006/0191721 A1 Aug. 31, 2006

(30) Foreign Application Priority Data

Jan. 30, 2003 (SE) ..... 03002284

(51) Int. Cl.
*E21B 10/22* (2006.01)

(52) U.S. Cl. ..... 175/371; 299/110

(58) Field of Classification Search ..... 299/110; 175/371

See application file for complete search history.

(56) References Cited

U.S. PATENT DOCUMENTS 2,627,431 A * 2/1953 Sechrist ..... 403/355
3,645,591 A 2/1972 Winberg
3,752,243 A 8/1973 Hummer et al.
4,448,271 A * 5/1984 Persson ..... 175/364
4,509,607 A * 4/1985 Saxman et al. ..... 175/227
5,295,549 A * 3/1994 Dolezal et al. ..... 175/371
5,839,523 A * 11/1998 Brolund ..... 175/228
5,961,185 A 10/1999 Friant et al.
5,984,024 A 11/1999 Strand

FOREIGN PATENT DOCUMENTS

JP 08210071 A * 8/1996

* cited by examiner

*Primary Examiner*—John Kreck
(74) *Attorney, Agent, or Firm*—Drinker Biddle & Reath LLP

(57) ABSTRACT

A roller cutter includes a hub having crushing members mounted on an outer periphery thereof, and a shaft on which the hub is mounted for rotation. Opposite ends of the shaft include respective spigots. Seals are disposed adjacent respective ends of the shaft and are arranged radially between the shaft and the hub for preventing leakage of lubricant. Covers are disposed axially outwardly of respective seals for covering the respective seals. Each cover includes a generally radially inwardly directed projection received in an indentation formed in an outer surface of the shaft to lock the cover axially and rotationally with respect to the shaft.

13 Claims, 6 Drawing Sheets

ROLLER CUTTER

BACKGROUND OF THE INVENTION

The present invention relates to a roller cutter for a drill head for rotary boring of a front of earth and rock formations.

A roller cutter for a known drill head is kept in a saddle via a shaft of the roller cutter, see for instance Persson U.S. Pat. No. 4,448,271. In Strand U.S. Pat. No. 5,984,024, a roller cutter is shown provided with covers that hold sealing members-in place in order to prevent grease from leaking out from the interior of the roller cutter. It is known to fasten the covers to the shaft in various ways, the known solutions meaning either complicated constructions or constructions that reduce the strength of the shaft.

OBJECTS OF THE INVENTION

One object of the present invention is to provide a roller cutter, the design of which contributes to longer operating periods.

Another object of the present invention is to provide a durable roller cutter.

Still another object of the present invention is to provide a roller cutter, the shaft of which does not crack so easy at load.

Still another object of the present invention is to provide a roller cutter, the cover of which is simple to fix (secure).

SUMMARY OF THE INVENTION

The invention relates to a roller cutter comprising a hub having crushing members mounted on an outer periphery thereof, and a shaft on which the hub is mounted for rotation about a center axis of the shaft. Opposite ends of the shaft include respective spigots. Seals are disposed adjacent respective ends of the shaft and are arranged radially between the shaft and the hub for preventing leakage of lubricant. Covers are disposed axially outwardly of respective seals for covering the respective seals. Each cover includes a generally radially inwardly directed projection received in an indentation formed in an outer surface of the shaft to lock the cover axially with respect to the shaft.

The invention also pertains to a raise boring cutter apparatus which includes the roller cutter described above.

BRIEF DESCRIPTION OF THE FIGURES

A preferred embodiment of the invention will be described more closely in the following, reference being made to the appended drawings.

DETAILED DESCRIPTION OF A PREFERRED EMBODIMENT

Figure 1:
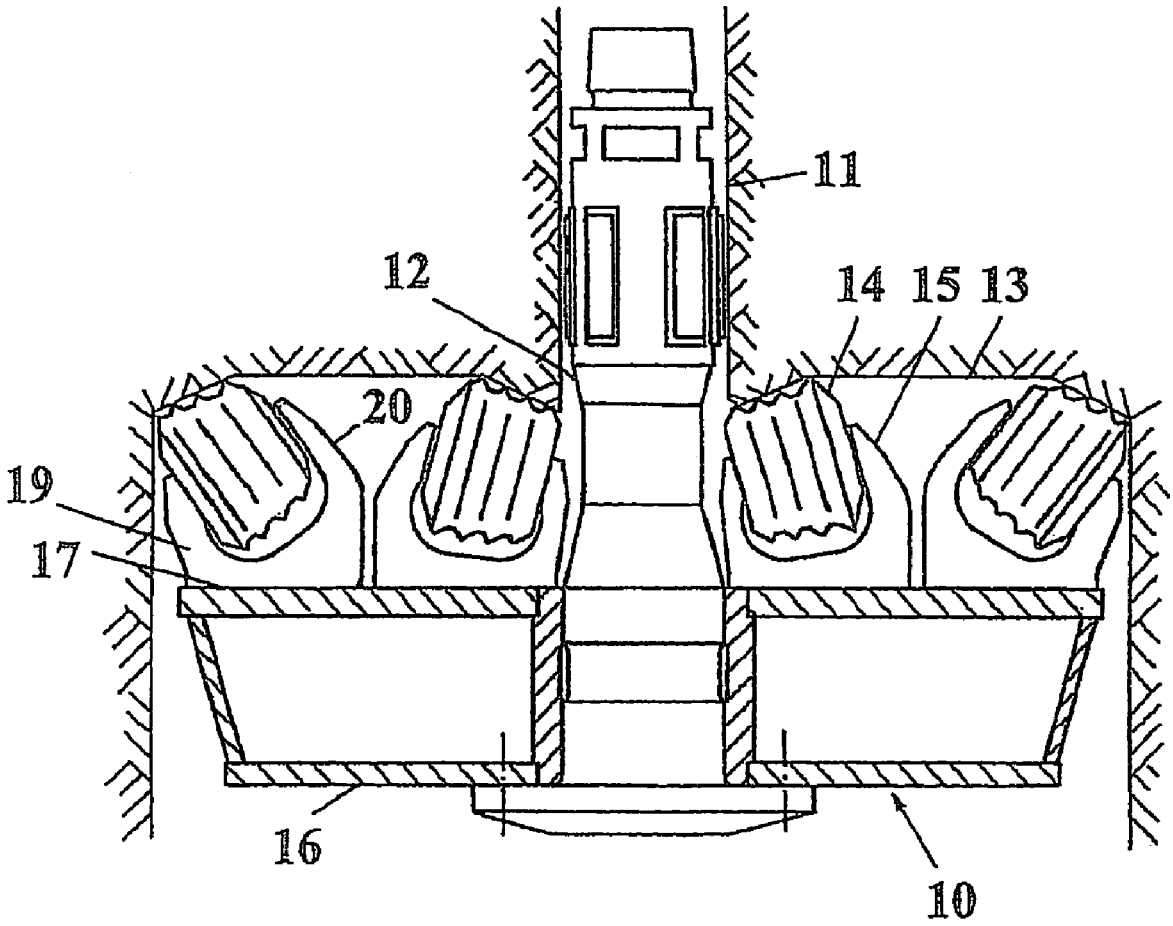
FIG. 1 shows an axial cross-section through a raise-boring head having roller cutters according to the invention as well as saddles.

In FIG. 1 is shown how a pilot hole 11, which in a known way is pre-drilled between an upper and a lower, not shown, level in a mine is reamed by means of a drill head designated 10. The drill head 10 is connected to a drive stem 12 by means of which the drill head is rotated and is pressed against a ring-shaped surface 13 that surrounds the pilot hole 11. The surface 13, thus, defines the face of the earth formation.

The invention relates to earth boring in general, but is primarily intended for raise boring. At raise boring, the pilot hole is drilled between the lower and the upper level in a mine, and then the pilot hole is reamed by means of a drill head having a large diameter.

The drill head 10 comprises a body 16 and a plurality of rollers or cutters 14, which are rotatably mounted on the body in fasteners or saddles 15. Each roller cutter comprises circumferential rows of buttons or crushing members of cemented carbide in a known way. The saddles 15 are mounted on the body 16. The drive stem 12 is connected to the body 16.

Figure 2A:
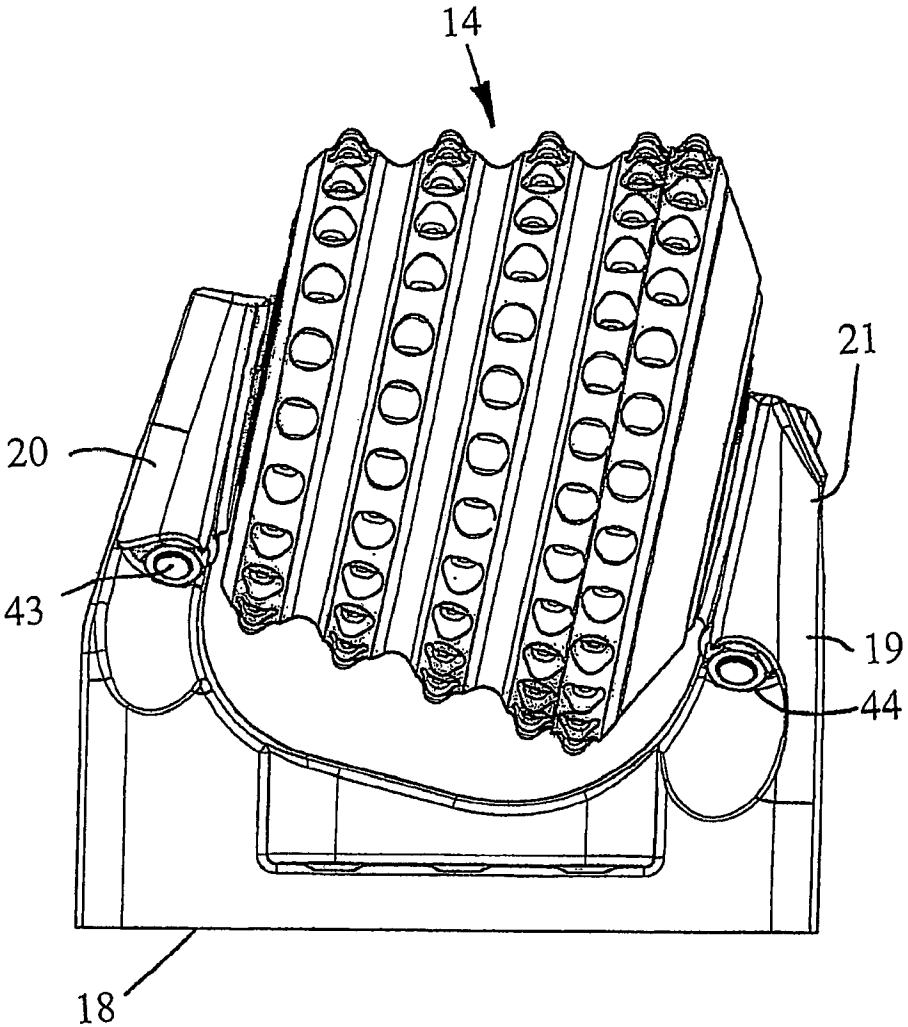
FIG. 2A shows a roller cutter according to the present invention as well as a saddle in side view included in the reamer bit in FIG. 1.
Figure 2B:
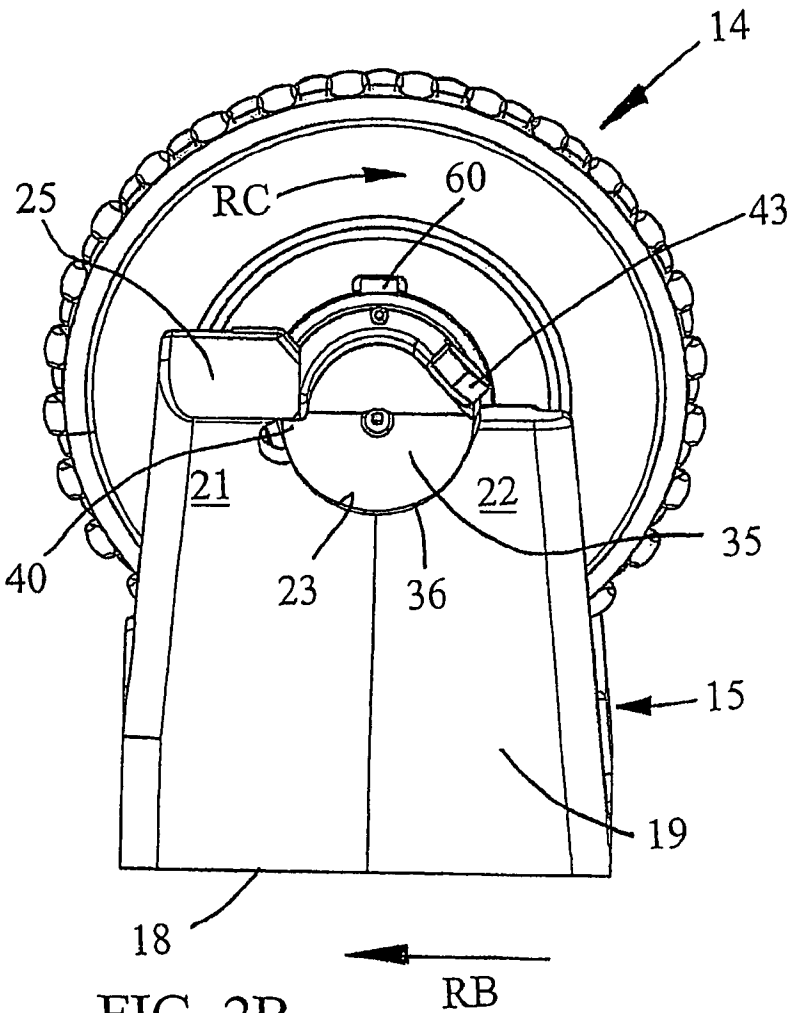
FIG. 2B shows a first end view of the roller cutter according to the present invention and the saddle.
Figure 2C:
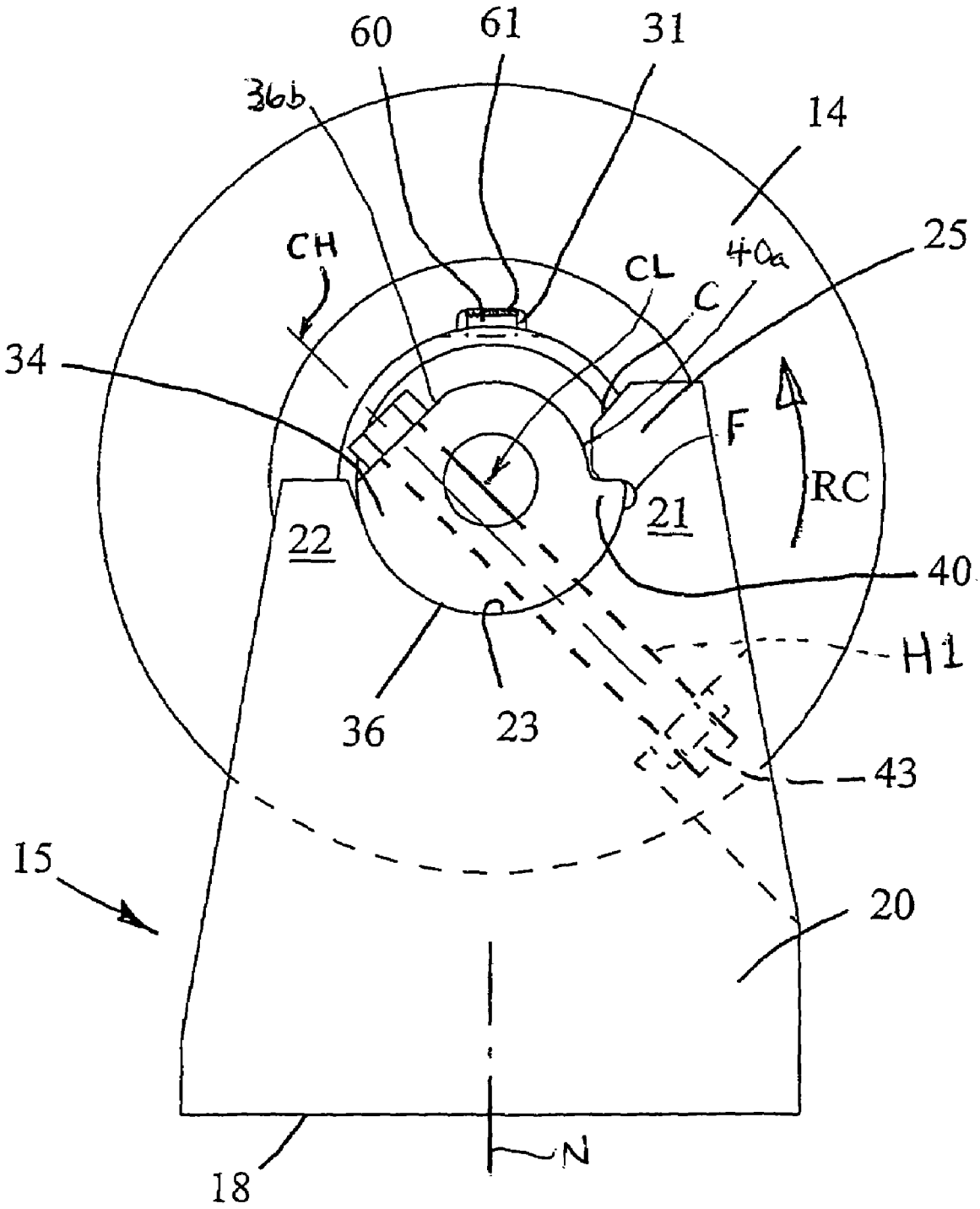
FIG. 2C shows schematically a second end view of the roller cutter and the saddle opposite the end view in FIG. 2B.

The body 16 has a mounting surface 17 on which the saddles 15 are carried. The saddle 15 comprises a bottom surface 18 (FIG. 2A), which is intended to be connected, for instance by screwing or welding, to the mounting surface 17. Furthermore, the saddle 15 comprises two legs 19, 20, between which the roller cutter 14 is mounted. The legs 19, 20 are, at the end thereof facing away from the bottom surface 18 formed with arms 21, 22. The arms 21, 22 have different lengths from the bottom surface 18, i.e. the arm 22 which leads in the direction of rotation RC of the drill head, see FIG. 2B, is longer than the trailing arm 21. The arms 21, 22 flank a cavity and each cavity has a concavely curved support surface 23, which is at least partly circular or cylindrical. A normal N of the support surface substantially perpendicular to the bottom surface 18 intersects the rotational axis or center line CL of the roller cutter 14. The support surface 23 connects forwardly in the direction of rotation RC of the roller cutter 14 via a fillet F to a shoulder or a collar 25. The shoulder 25 protrudes inside of an imaginary circle, touches or entirely or partly coincides with the support surface 23. The shoulder 25 comprises a stop surface, which is in substantially parallel with a plane that intersects the rotational axis of the roller cutter. The support surface connects further to a chamfer C, which substantially follows a tangent to the support surface 23 at the end arranged substantially diametrically opposite the fillet or the shoulder. The chamfer widens the space around the support surface 23 and is intended to facilitate entering of the shaft spigot of the roller cutter 14 in the saddle. A first through-going hole H1 is arranged in each leg 21, which in the embodiment illustrated mouths in the support surface 23 on the same side of the normal N as the shoulder 25 has been arranged. The hole is arranged in the center area of the support surface as seen in the axial direction of the roller cutter. The center line CH of the hole does not intersect center line CL of the hub 24 but has an extension under the same at a perpendicular distance from the center line of the roller cutter. Fastening devices in the form of threaded bolts 43 and nuts 44 are intended to hold the roller cutter and the saddle together, the bolt 43 passing through the hole H1.

The roller cutter 14 comprises a hardened shaft 33, each end of which has a shaft spigot 34 and 35. Each spigot has a substantially cylindrical or convex support surface 36, which is intended to abut against the support surface 23 in the saddle. The support surface 36 has an extension approximately 1800 in the circumferential direction. Each shaft spigot 34, 35 is formed with a second through-going hole H2, which intersects a planar surface 36*a* as well as the convexly curved support surface 36. The support surface 36 connects forwards in the direction of rotation RC of the roller cutter 14 to a recess which forms an upwardly facing shoulder 40 and a cylindrical, convex free surface 40*a*. The free surface is intended to form a space for the shoulder 25 so that the shaft should be able to be rotated about 45° in the saddle. The planar surface 36*b* is intended to constitute abutment for the head of a bolt at assembly.

The shaft 33 preferably has an internally hollow space 37 intended to form a gap for feeding of balls to ball bearings and to accept on one hand a lubricating device and on the other hand a protective plug, as is disclosed in U.S. Pat. No. 5,984,024, which hereby is incorporated in the present description.

Figure 3A:
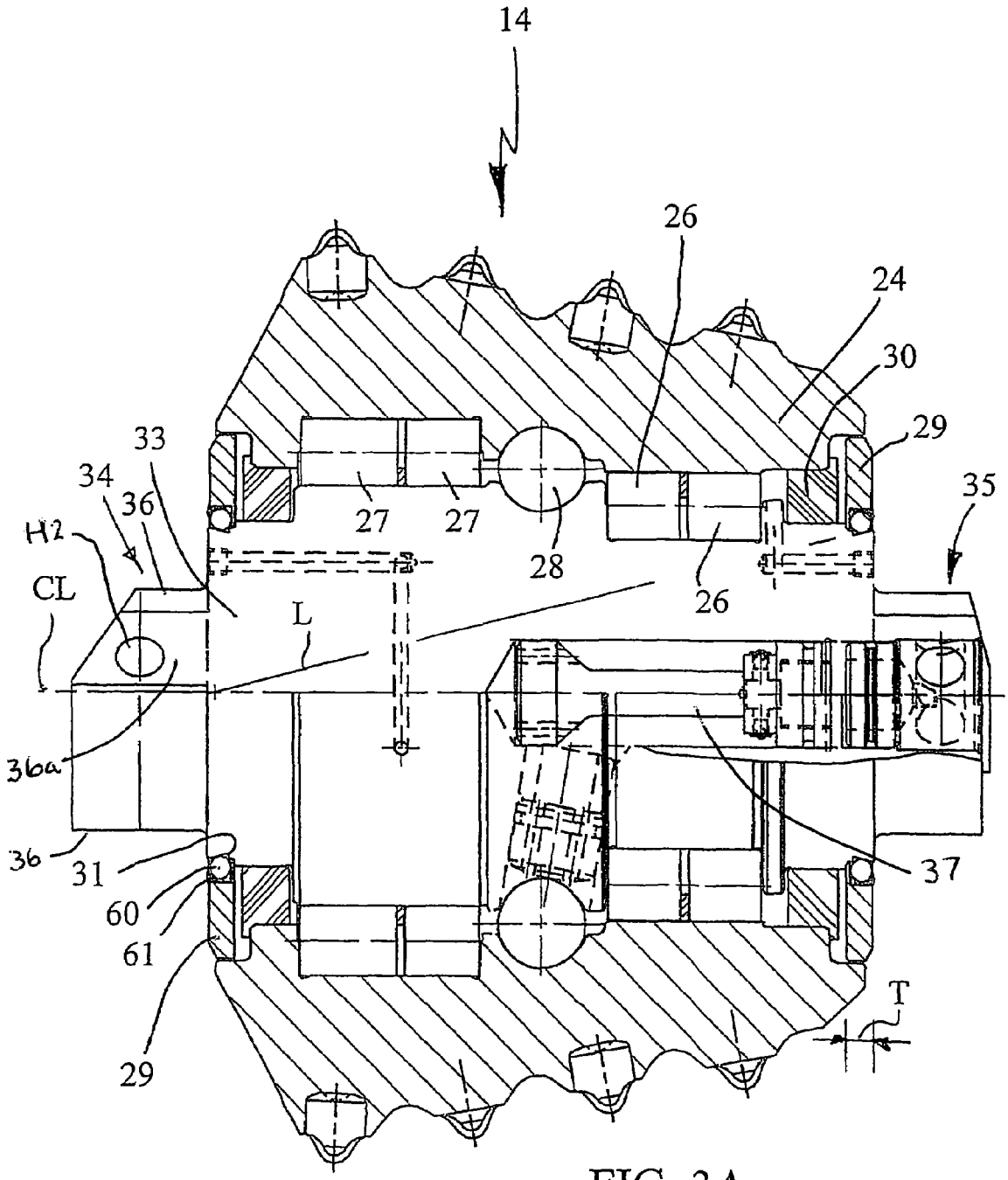
FIG. 3A shows the roller cutter according to the present invention in a partial cross-section.

The shaft 33 according to FIG. 3A has a longitudinal center line CL. A hub 24 is rotatably mounted on the shaft 33 via bearing members 26 and 27, respectively. The bearing member 26 is received in a first groove in the shaft 33, which groove is tangential and extends circumferentially, while the bearing member 27 is received in a second groove in the hub 24, which groove is tangential and extends circumferentially. The hub 24 is locked axially in relation to the shaft 33 by means of lock member 28, preferably in the form of balls, which co-operate with third and fourth grooves in both the shaft 33 and the hub 24, which grooves are tangential and extend circumferentially.

The roller cutter 14 is rotatable relative to sealing support members or covers 29 located at the axial ends of the hub 24. The cover 29 shall protect sealing members 30, which prevent grease from leaking out from the interior of the roller cutter 14. The sealing members are mounted between the hub 24 and the shaft 33 in order to prevent grease leakage therebetween. The sealing member 30 is schematically shown in the figures and comprises an advanced seal comprising spring steel and rubber, half of the member being connected to the shaft 33 and the other half being connected to the hub 24. The sealing member 30 is applied between a flange 33*a*, in which a grease duct or evacuation hole 33*b* (see dashed lines in FIG. 3B) terminates, and one of the covers 29. The covers 29 are also arranged to counteract penetration of drill dust into the bearings. Both covers 29 are circle ring-shaped and have a thickness T (FIG. 3A). The cover 29 may have an axially directed peripheral flange (not shown), possibly passing the radially outer portion of the associated sealing member 30. Each cover 29 comprises two recesses 31, which are arranged diametrically opposite to each other. Each recess 31 comprises a rectangular groove, which has an extension from a radially inner bordering surface 62, corresponding to the inner diameter of the circle ring, and radially outwardly. The groove is not through-going in the thickness direction of the cover but an axial inner wall 32 anvil. The wall 32 is substantially perpendicular to the thickness direction of the cover.

Figure 3B:
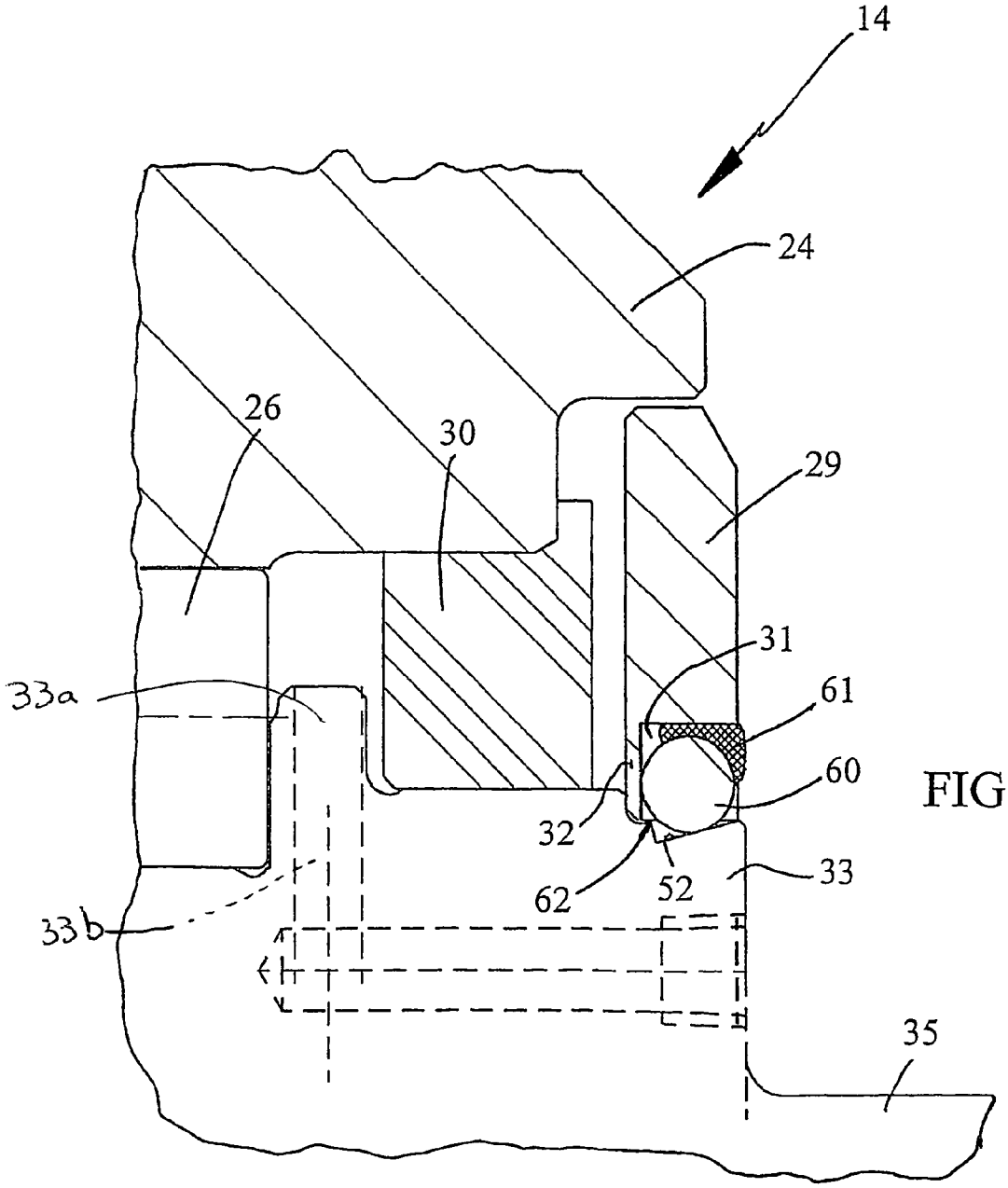
FIG. 3B shows an enlarged section according to FIG. 3A.
Figure 3C:
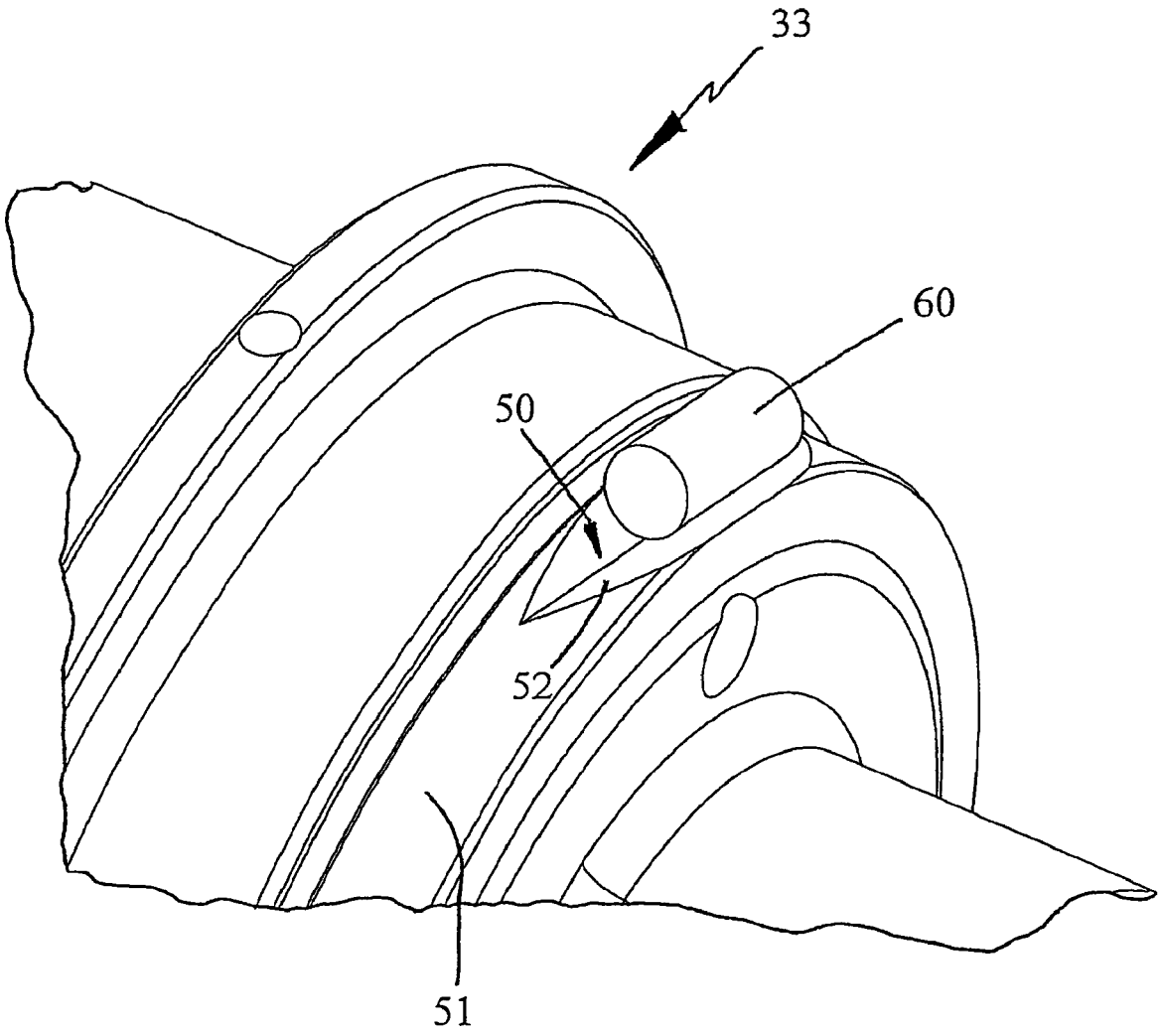
FIG. 3C shows a part included in the roller cutter, in perspective view.

The shaft 33 has an indentation or groove 50 arranged in the envelope surface 51 of the shaft, which is best seen in FIGS. 3B and 3C. The groove 50 is substantially V-shaped and comprises a surface 52 angled in the axial direction. The groove 50 is arranged radially outside of the shaft spigot 34, 35. The surface 52 slopes downwardly and inwardly in the direction towards the opposite shaft spigot 34. An imaginary extension line L of the surface 52 intersects the center line CL in or near the opposite shaft spigot 34. The groove 50 has substantially the same width in the lateral direction of the shaft as the width of the recess 31 or somewhat greater.

A pin or projection 60 of weldable steel material is intended to be inserted into the recess 31 and the groove 50 when the cover 29 has been placed around the shaft 33. The pin 60 is solid and has a right cylindrical basic shape The opening, which is formed by the recess 31 and the surface 52, has an axially outer mouth which is substantially equally large as the diameter of the pin or somewhat larger. The pin is inserted through said opening and will then support, by means of linear abutment against the surface 52 of the shaft and against the axially inner wall 32 of the cover. Then, a weld 61 is laid between the pin and the recess 31 in order to secure the axial position of the pin in relation to the cover. The pin 60 will then project radially inside the radially inner bordering surface 62 of the cover. Alternatively, the pin may instead of by means of welding be locked by means of some mechanical fastening member, e.g., a screw.

The corresponding procedure is carried out at the other opposite recess on the cover as well as at the recesses of the second cover. If there is a gap between the pin 60 and the surface 52 after the welding, the cover will be able to be moved a limited distance in the axial direction before contact arises between the pin 60 and the surface 52, whereby the cover is being prevented from falling down on the shaft spigot 35.

At use of the drill head, frictional forces will want to rotate the covers. However, the pins 60 lock the covers against rotation in relation to the shaft without any weld affecting the strength of the hardened shaft being difficult to weld. Thus, the cover 29 comprises a radially directed projection 60, which is arranged to be received in an indentation 50 in the envelope surface of the shaft 33 in order to lock the cover axially in relation to the shaft. Furthermore, the cover is also locked in the tangential direction, i.e. the cover is rotationally secured, by means of co-operation between the projection 60 and the indentation 50.

Thus, the present invention relates to a roller cutter for rotary boring of the-front of earth and rock formations, the designs of which contribute to longer operating periods by means of more durable roller cutters, the shaft of which does not crack as easy at load and the cover of which is simple to fix.

The invention claimed is:

1. A roller cutter comprising:

a hub having crushing members mounted on an outer periphery thereof;

a shaft on which the hub is mounted for rotation about a center axis of the shaft, opposite ends of the shaft including respective spigots;

a pair of lubricant seals disposed adjacent respective ends of the shaft and extending radially between and contiguously engaging the shaft and the hub; and a pair of covers spaced axially outwardly from and covering the respective seals, each cover including a generally radially inwardly directed projection received in an indentation formed in an outer surface of the shaft to lock the cover axially with respect to the shaft.

2. The roller cutter according to claim 1, wherein each projection comprises a pin secured in a recess formed in the respective cover, wherein the pin extends radially inwardly past an inner diameter of the cover.

3. The roller cutter according to claim 2 wherein each indentation comprises a groove of substantially V-shape when viewed in a section plane containing the center line.

4. The roller cutter according to claim 3 wherein each indentation has a dimension extending generally tangentially to the shaft which is at least as long as a dimension of the recess in the same direction.

5. The roller cutter according to claim 3 wherein each spigot includes a curved support surface and a shoulder extending generally radially inwardly form the support surface.

6. The roller cutter according to claim 3 wherein each indentation includes a surface which extends in a direction which is inclined axially inwardly and radially inwardly, the projection engaging both the inclined surface and an axially outwardly facing surface of the cover.

7. The roller cutter according to claim 3 wherein the projection is arranged to lock the cover against substantial rotation relative to the shaft.

8. The roller cutter according to claim 1 wherein each indentation comprises a groove of substantially V-shape when viewed in a section plane containing the center line.

9. The roller cutter according to claim 2 wherein each indentation has a dimension extending generally tangentially to the shaft which is at least as long as a dimension of the recess in the same direction.

10. The roller cutter according to claim 1 wherein each spigot includes a curved support surface and a shoulder extending generally radially inwardly form the support surface.

11. The roller cutter according to claim 1 wherein each indentation includes a surface which extends in a direction which is inclined axially inwardly and radially inwardly, the projection engaging both the inclined surface and an axially outwardly facing surface of the cover.

12. The roller cutter according to claim 1 wherein the projection is arranged to lock the cover against substantial rotation relative to the shaft.

13. A raise boring cutter apparatus comprising:

a body having a mounting surface and saddles projecting upwardly from the mounting surface;

a roller cutter mounted on the saddles and comprising:

a hub having crushing members mounted on an outer periphery thereof, and a shaft on which the hub is mounted for rotation about a center axis of the shaft, opposite ends of the shaft including respective spigots mounted non-rotatably in respective saddles, a pair of lubricant seals disposed adjacent respective ends of the shaft and extending radially between and contiguously engaging the shaft and the hub; and a pair of covers spaced axially outwardly from and covering the respective seals, each cover including a generally radially inwardly directed projection received in an indentation formed in an outer surface of the shaft to lock the cover axially with respect to the shaft.

* * * * *